US006390043B1

(12) United States Patent
Niethammer et al.

(10) Patent No.: US 6,390,043 B1
(45) Date of Patent: May 21, 2002

(54) DEVICE FOR HYDRAULICALLY ADJUSTING THE ANGLE OF ROTATION OF A SHAFT IN RELATION TO A DRIVING WHEEL

(75) Inventors: Bernd Niethammer, Nurtingen; Andreas Knecht, Ammerbuch, both of (DE)

(73) Assignee: Dr. Ing.H.C.F. Porsche AG, Weissach (DE)

( * ) Notice: Subject to any disclaimer, the term of this patent is extended or adjusted under 35 U.S.C. 154(b) by 0 days.

(21) Appl. No.: 09/674,707

(22) PCT Filed: Apr. 14, 1999

(86) PCT No.: PCT/EP99/02504

§ 371 Date: Jan. 26, 2001

§ 102(e) Date: Jan. 26, 2001

(87) PCT Pub. No.: WO99/57423

PCT Pub. Date: Nov. 11, 1999

(30) Foreign Application Priority Data

May 5, 1998 (DE) ..... 198 19 995

(51) Int. Cl.[7] ..... F01L 1/344
(52) U.S. Cl. ..... 123/90.17; 74/568 R
(58) Field of Search ..... 123/90.15, 90.17, 123/90.31; 74/568 R; 464/1, 2, 160

(56) References Cited

U.S. PATENT DOCUMENTS 4,858,572 A 8/1989 Shirai ..... 123/90.12
5,215,046 A 6/1993 Obata et al. ..... 123/90.17
5,341,777 A * 8/1994 Miura et al. ..... 123/90.17
5,836,276 A * 11/1998 Iwasaki et al. ..... 123/90.17
5,836,277 A * 11/1998 Kira et al. ..... 123/90.17
6,085,708 A * 7/2000 Trzmiel et al. ..... 123/90.17

FOREIGN PATENT DOCUMENTS

| | | |
|---|---|---|
| CH | 243 908 | 2/1947 |
| DE | 39 22 962 | 1/1991 |
| EP | 0 652 354 | 5/1995 |
| JP | 59-229011 | 12/1984 |

* cited by examiner

*Primary Examiner*—Wellun Lo
(74) *Attorney, Agent, or Firm*—Crowell & Moring LLP

(57) ABSTRACT

A device for changing the angle of rotation of a camshaft of an internal combustion engine relative to a driving wheel. The device includes an inner part, which is provided with bridges or wings, and is disposed rotationally movable in a cell wheel. The driven cell wheel has several bridges, which are distributed over the periphery and divided by bridges or wings of the inner part into in each case two pressure spaces. The change in the angular position is caused by applying pressure on or relieving pressure from the two pressure spaces. As an end position is approached, the adjusting movement is damped hydraulically by integrated damping means. These damping means are formed by the interaction of the mutually approaching bridges of the inner part and of the cell wheel.

5 Claims, 3 Drawing Sheets

DEVICE FOR HYDRAULICALLY ADJUSTING THE ANGLE OF ROTATION OF A SHAFT IN RELATION TO A DRIVING WHEEL

BACKGROUND AND SUMMARY OF THE INVENTION

The invention relates to a device for hydraulically adjusting the angle of rotation of a shaft to a driving wheel, especially of the camshaft of an internal combustion engine.

Such a device is known, for example, from U.S. Pat. No. 4,858,572. In the case of a device of this type, an inner part is connected, so that there cannot be any mutual rotation, with the end of the camshaft, which has at its outside several radial slots, which are distributed over the periphery and in which wing elements are guided radially displaceably. This inner part is surrounded by a cell wheel, which has several cells, which can be acted upon hydraulically and are divided by the wings into two pressure spaces acting against one another on these cells. By the action of pressure on these pressure spaces, the cell wheel, as a function of the pressure difference, can be twisted relative to the inner part and with that, to the camshaft. Moreover, in the cell wheel in each of two radial boreholes in defined angular positions, a piston, which can be acted upon hydraulically and, in the assigned end position of the device, can be pushed into a radial recess of the inner part. These pistons are acted upon by compression spring elements in the direction of the inner part and can be shifted in the opposite direction by hydraulic action on the boreholes. By means of these pistons, which are acted upon by springs, the device is to be locked in one of its two end positions as long as the pressure for acting upon the pressure spaces has not reached a defined level. Only when a particular pressure level is reached are the pistons pushed back against the action of the compression springs and the inner part can be twisted relative to the cell wheel. Rattling noises, for instance, which are due to changing torque loads during the starting up and operation of the internal combustion engine, are to be avoided with such a devise during the starting up of the internal combustion engine. Furthermore, from the DE 39 22 962 A1, a device is known for hydraulically adjusting the angle of rotation of a camshaft to its driving wheel, for which the inner part is provided with fixed, radially extending bridges. Between the bridges of the inner part and the opposite bridges or walls of the cell wheel, compression springs are mounted which, when the pressure acting is reduced, move the inner part relative to the cell wheel into one of the two end positions.

These known devices for hydraulically adjusting the angle of rotation of a shaft to its driving wheel have the disadvantage that, during the operation of such a device, due to the impact between the bridges of the inner part and the adjoining walls or bridges of the cell wheel when one of the two end positions is reached, high stresses and increased development of noise may occur. This increased formation of noise has a disturbing effect during the operation of such a device. Moreover, the impact load of the bridges upon reaching the end position and resulting from the action of pressure and from the torque, acting from the driving mechanism on the cell wheel, can lead to appreciable stresses which under some circumstances can have a negative effect on the service life of such a device.

In contrast to the above, it is an object of the invention to improve a hydraulic adjustment of the angle of rotation of a shaft to its driving wheel so that increased impact loads are avoided when one of the two end positions is reached and that the thereby caused noise formation and component stress are reduced.

Pursuant to the invention, this objective is accomplished. If the change in the rotational position is damped hydraulically by integrated damping means before one of the two end positions is reached, the mechanical impact load is reduced distinctly. By means of this hydraulic damping before the respective end position is reached, it can be ensured that, in particular, the relative speed of the two components to one another is clearly reduced. The energy, which must otherwise be converted during the undamped approach to the end position at the stop can thus be reduced to a large extent by the hydraulic damping. In this connection, it is particularly advantageous if the hydraulic dampening is designed in the form of an end position damping, which becomes active only when the end position is approached otherwise does not affect the adjusting process.

The integrated hydraulic damping can be constructed particularly advantageously in the form of a hydraulically acting damping throttle.

An integrated damping, which becomes effective when the respective end position is approached, can be attained in a particularly advantageous manner, if a throttle chamber, in which a pressure medium is enclosed before the throttle position is reached, is constructed between the bridges of the inner part and the bridges of the cell wheel. By means of such a throttle chamber, which can be constructed between components moved relative to one another, an angularly accurate assignment of the start of the dampening or of a damping, setting in when a defined position is reached, can be set by suitable size dimensions. With that, it is possible to ensure in a particularly advantageous manner that the adjusting process takes place over the largest possible angular range.

An end position damping, which is particularly advantageous with respect to the mechanical stressing of the components, results when the throttle chamber pressure can be relieved over a defined throttle gap. As the end position is approached, the pressure medium, enclosed in the pressure chamber, can emerge throttled relatively severely over this throttle gap, so that excessive damping is avoided. Moreover, by constructing the sealing gap appropriately, it can furthermore be ensured that the mechanically limited end position can be reached in any case. Disadvantageous spring effect can thus be prevented effectively.

Such a throttle chamber can be constructed particularly advantageously, if in each case a recess is constructed in one of the respectively adjacent bridges and a corresponding extension in the other bridge. As the two adjacent bridges approach one another, the projection dips into the recess, so that the opposite regions of the wall close off the throttle chamber or form the throttle gap by means of their overlap.

Further advantages and advantageous further developments of the invention arise out of the dependent claims and the specification.

An example of the invention is described in greater detail below and in the drawing, in which

DETAILED DESCRIPTION OF THE PREFERRED EMBODIMENTS

Figure 1:
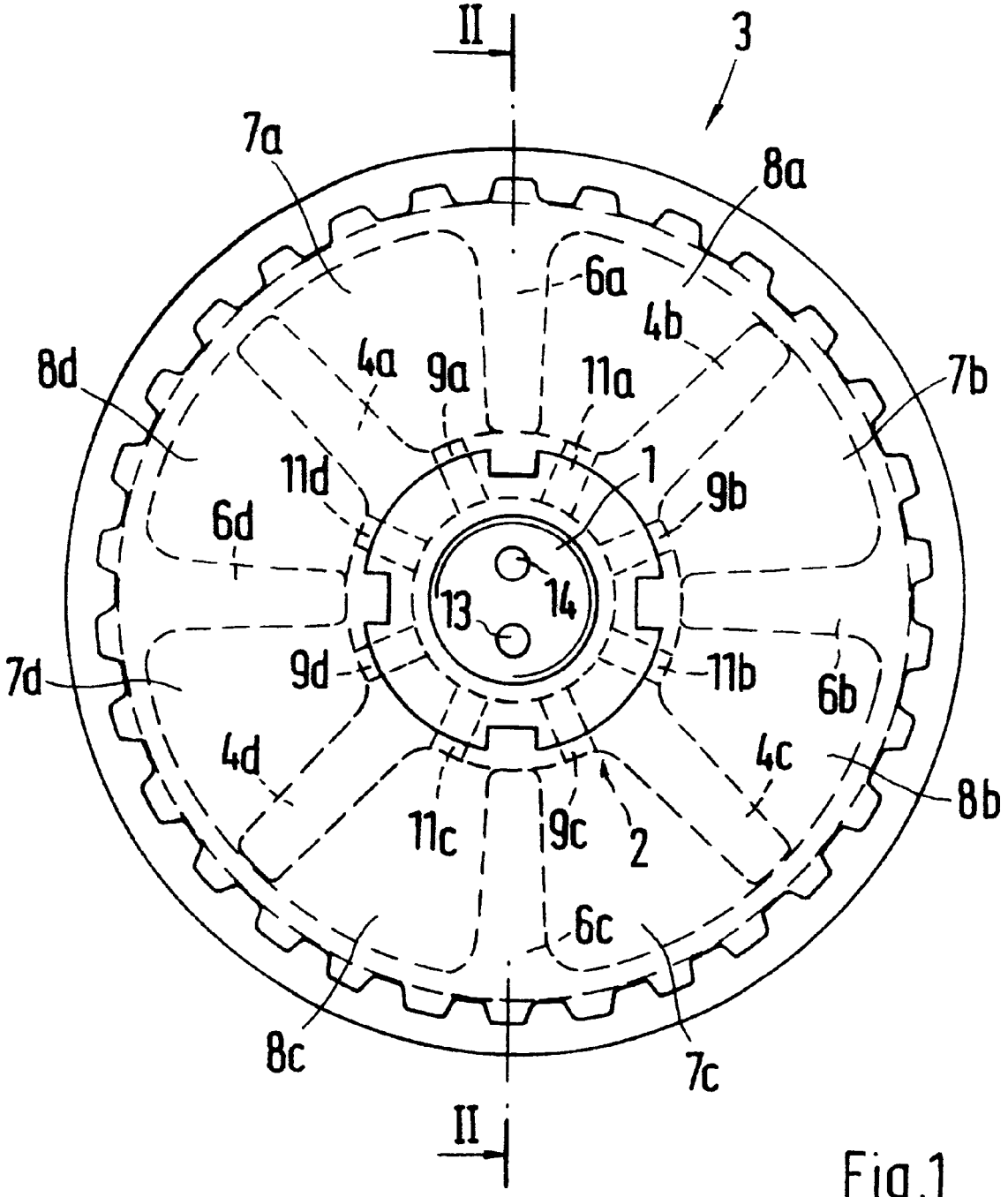
FIG. 1 shows a view of the adjusting device, as seen from the side averted from the camshaft.
Figure 2:
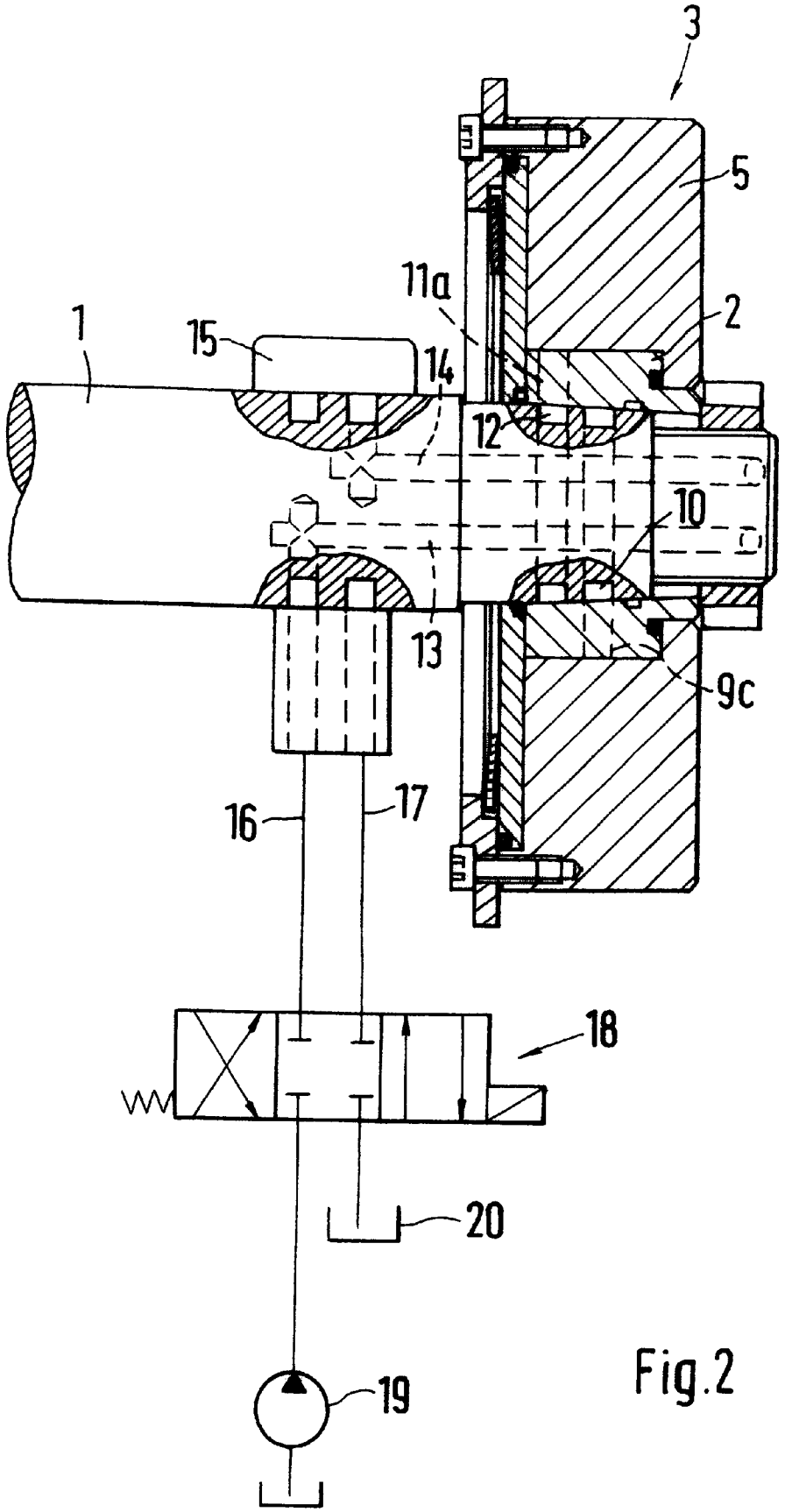
FIG. 2 shows a simplified section along the line II—II of FIG. 1.

In the drawing, a camshaft 1 of an internal combustion engine is shown, at the free end of which the inner part 2 of an adjusting device 3 is disposed so that there cannot be any mutual rotation. In this example, this inner part 2 is provided with four bridges 4*a* to 4*d,* which are disposed radially. The inner part is enclosed by a cell wheel 5, which is connected in a manner, the details of which are not shown, with the crankshaft of the internal combustion engine and consequently acts as a driving wheel. The cell wheel 5 is provided with four inwardly protruding radial bridges 6*a* to 6*d,* between which four cells are formed, which are divided by the bridges of the inner part into in each case two pressure spaces 7*a* to 7*d* and 8*a* to 8*d.* These pressure spaces are constructed so that the sum of the hydraulically effective surfaces is the same in the two adjusted positions. The pressure spaces 7*a* to 7*d* are connected in each case over a radial borehole 9*a* to 9*d* in the inner part with an annular groove 10 at the camshaft 1. The pressure spaces 8*a* to 8*d* are connected in an analogous manner over radial boreholes 11*a* to 11*d* in the inner part with a second annular groove 12 in the camshaft. The radial boreholes 9*a* to 9*d* and 11*a* to 11*d* are in each case disposed so that they discharge in each case into the appropriate pressure spaces in the foot region of the bridges 4*a* to 4*d.* The two annular grooves 10 and 12 are in each case connected with one pressure channel 13 or 14 extending in the camshaft. These pressure channels 13 and 14 are connected in a known manner over camshaft bearing 15 with in each case one control line 16 or 17. The two control lines 16 and 17 are connected with a control valve 18, which is constructed, for example, as a 4/3-way valve. This control valve 18 is connected moreover with a pump 19 for the pressure medium and with an oil tank 20.

In the shifting position II (neutral position) of the control valve 18, shown in FIG. 1, the connections to the two control lines 16 and 17, the pressure medium pump 19 and the oil tank 20 are in each case closed off at one side. In this shifting position, the adjusting device is clamped hydraulically and retains the respective relative positional assignment of the inner wheel to the cell wheel. In the shifting position I of the control valve 18, the pressure spaces 7*a* to 7*d* are connected over the boreholes 9*a* to 9*d,* the annular groove 10, the pressure channel 14 and the pressure line 17 with the pressure medium pump 19 and are acted upon correspondingly with pressure. At the same time, the pressure spaces 8*a* to 8*d* are connected over the boreholes 11*a* to 11*d,* the annular groove 12, the pressure channel 13 and the pressure line 16 with the oil tank 20 and therefore the pressure on them is relieved. By the action of pressure on the pressure spaces 7*a* to 7*d,* the inner part 2 is twisted towards the cell wheel 5 in the counterclockwise direction in the viewing direction selected in FIG. 1. At the same time, by means of this twisting, the pressure medium in the pressure spaces 8*a* to 8*d* is additionally displaced to the oil tank. On the other hand, in the shifting position III of the control valve 18, the pressure spaces 8*a* to 8*d* are connected with the pressure medium pump and the pressure spaces 7*a* to 7*d* are connected with the oil tank 20 over the previously described line connections. Due to this action of pressure, the inner part 2 is twisted counterclockwise relative to the cell wheel.

Figure 3A:
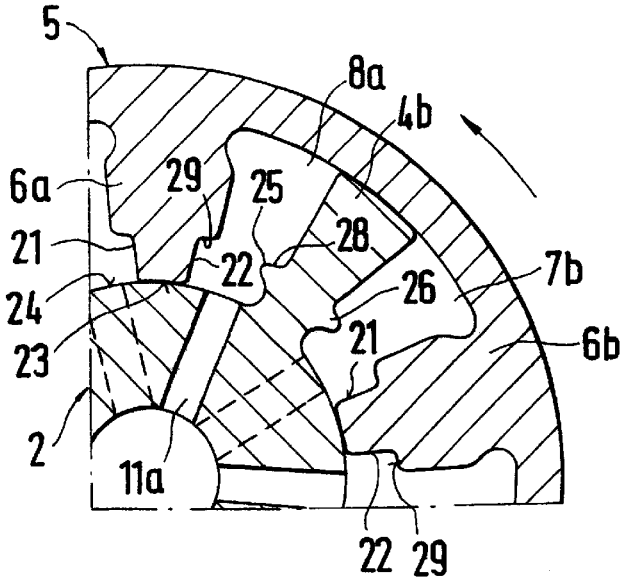
FIG. 3*a* shows an enlarged partial view of FIG. 1 in a first position of rotation.

The cell wheel 5 and the inner part 2 are in each case constructed symmetrically. For the sake of simplification, the embodiment of the bridges of the inner part and of the cell wheel, shown in greater detail in FIGS. 3*a* to 3*c,* are shown in each case only by the example of one bridge and one pressure space bounded by this. However, what is shown applies equally well to the other bridges and pressure spaces. Moreover, in FIGS. 3*a* to 3*c* and the following description, only the approach to the end position similar to the shifting position I is shown and described. The approach to the opposite end position (shifting position II) is similar. Recesses 21 and 22 are developed at the bridges 6*a* to 6*d* of the cell wheel in the region of their ends facing the inner part. These recesses 21, 22 extend over the whole width (in the axial direction) of the respective bridge. The recesses 21, 22 extend in the radial direction approximately over the inner third of the respective bridge and extend up to the front side 23 or up to the adjoining peripheral surface 24 of the inner part 2.

Figure 3B:
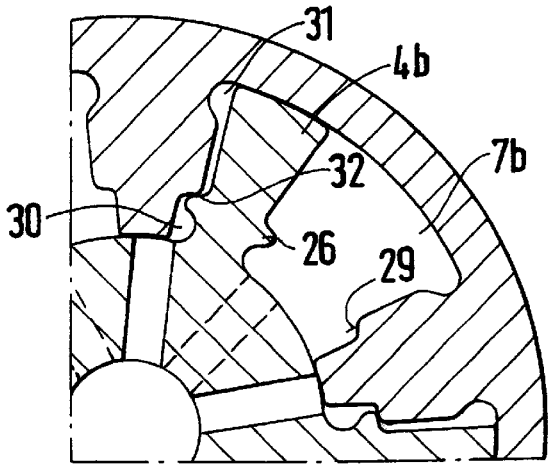
FIG. 3*b* shows an enlarged partial view of FIG. 1 during the approach to an end position and FIG. 3*c* shows an enlarged partial view of FIG. 1 when the end position is reached.
Figure 3C:
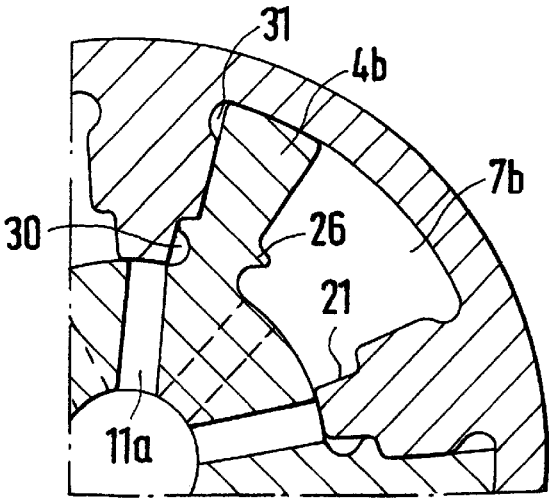

At the bridges 4*a* to 4*d* of the inner part 2, in each case a projection 25 and 26 is formed at the opposite sides. The position of these projections 25 and 26 is coordinated, so that it corresponds with the respectively adjacent recesses 21 and 22. In each case, the projections 25 interact with the recesses 22 and the projections 26 interact with the recesses 21 of the respectively adjoining bridge. The recesses 25 and 26 also extend over the whole width (in the axial direction) of the bridges. In contrast to the recesses, however, they do not extend in this example up to the peripheral surface of the inner part, so that their undersides 27 are at a distance from this inner part. There is a slight radial distance between the upper sides 28 of the projections 25, 26 and the shoulders 29 of the recesses 21 and 22, so that, as the end position is approached as shown in FIG. 3*b,* the projections can dip into the recesses forming a throttling gap 32.

As the end position is approached (FIG. 3*b*), the projection 25 dips into the recess 22. At the same time, the pressure spaces 8*a* to 8*d* are in each case divided into two partial pressure spaces 30 and 31. The partial pressure space 30 at the foot of the bridges 4*a* to 4*d* of the inner part 2 continues to be connected with the boreholes 11*a* to 11*d* in each case discharging into the pressure space. The radially outer partial space 31, acting as throttling chamber 31, is largely separated from the partial space 30 by the overlapping of the upper side 28 and the shoulder 29 and is connected with this only over the resulting throttling gap 32. Upon further twisting up to the end position (direct contact between the bridges, FIG. 3*c*), the pressure medium in the partial pressure space 31 can be displaced only in a highly throttled manner over this throttling gap 32 into the partial pressure space 31 and from this into the borehole 11*a.* The resulting throttling effect then depends on the effect of the viscosity and, above all, on the height and length of the throttling gap. The length of the throttling gap increases with increasing overlap. The height of the throttling gap depends on the distance between the upper side 28 and the shoulder 29. By matching the height of the throttling gap, the throttling action can be matched to the particular use conditions. In this example, the upper side and the shoulder extend largely parallel to one another. Therefore, as the bridges increasingly approach one another, the throttling action increases at least approximately proportionally to the increase in the overlap or to the lengthening of the throttling gap, that is, with increasing approach to the end position. However, it is also readily possible to vary the height of the throttling gap, so that the effect of the change in the length of the throttling gap is intensified or diminished. This can be accomplished, for example, by the wedge-shaped arrangement of the upper side relative to the shoulder.

What is claimed is:

1. A device for changing an angle of rotation of a camshaft of an internal combustion engine relative to a driving wheel, comprising:

an inner part which is fixedly connected with the rotatable camshaft and having bridges extending substantially radially; and a wheel having a plurality of cells distributed over a periphery of the cell wheel, the plurality of cells being bounded by bridges formed on the cell wheel and each cell being divided by the bridges of the inner part into two pressure spaces, wherein the camshaft is rotatable between two end positions relative to the cell wheel by the application of a pressure medium on or relieving the pressure medium from the two pressure spaces, wherein a change in a rotation position of the camshaft is damped hydraulically by integrated damping agents before one of the two end positions is reached, and wherein a throttle chamber is formed by a recess in a bridge of one of the inner part and the cell wheel and an adjoining projection in a neighboring bridge of the other of the cell wheel and of the inner part.

2. The device of claim 1, wherein the damping agents are constructed as a damping throttle.

3. The device of claim 1, wherein the hydraulic damping proceeds on an outlet side of the pressure spaces.

4. A device for changing an angle of rotation of a camshaft of an internal combustion engine relative to a driving wheel, comprising:

an inner part which is fixedly connected with the rotatable camshaft and having bridges extending substantially radially; and a wheel having a plurality of cells distributed over a periphery of the cell wheel, the plurality of cells being bounded by bridges formed on the cell wheel and each cell being divided by the bridges of the inner part into two pressure spaces, wherein the camshaft is rotatable between two end positions relative to the cell wheel by the application of a pressure medium on or relieving the pressure medium from the two pressure spaces, wherein a change in a rotation position of the camshaft is damped hydraulically by integrated damping agents before one of the two end positions is reached, wherein when one of the two end positions are approached, a plurality of pressure spaces are divided into two partial pressure spaces, between which a throttling gap is formed, and wherein the throttling gap is formed by a peripheral surface of a recess formed in a bridge of the cell wheel and a peripheral surface of a projection formed on a bridge of the inner part.

5. The device of claim 4, wherein the cell wheel and the inner part are constructed as sintered parts and the projections and recesses of the cell wheel and the inner part are produced during the sintering process.

* * * * *